US005431220A

United States Patent [19]

Lennon et al.

[11] Patent Number: 5,431,220

[45] Date of Patent: Jul. 11, 1995

[54] WHIPSTOCK STARTER MILL ASSEMBLY

[75] Inventors: W. L. Lennon, Corsicana; Joseph V. Hebert, Tomball; Thomas F. Bailey; John E. Campbell, both of Houston, all of Tex.

[73] Assignee: Smith International, Inc., Houston, Tex.

[21] Appl. No.: 217,519

[22] Filed: Mar. 24, 1994

[51] Int. Cl.[6] ..... E21B 7/08; E21B 23/00

[52] U.S. Cl. ..... 166/55.7; 166/117.6; 175/81; 175/82

[58] Field of Search ..... 166/55.6, 55.7, 117.5, 166/117.6; 175/61, 79, 81, 82

[56] References Cited

U.S. PATENT DOCUMENTS

| | | | |
|---|---|---|---|
| 1,338,773 | 5/1920 | Hill . | |
| 1,636,032 | 7/1927 | Abbott | 166/117.6 |
| 1,795,553 | 3/1931 | Getty | 166/117.6 |
| 2,014,805 | 9/1935 | Hinderliter | 166/117.6 |
| 2,048,530 | 12/1936 | Yancey . | |
| 2,501,761 | 3/1950 | D'Arcy . | |
| 2,638,320 | 5/1953 | Condra . | |
| 2,882,015 | 4/1959 | Beck . | |
| 2,953,350 | 9/1960 | Moore | 166/117.5 |
| 3,332,492 | 7/1967 | Thomas . | |
| 4,144,936 | 3/1979 | Evans . | |
| 4,266,621 | 5/1981 | Brock . | |
| 4,397,355 | 8/1983 | McLamore | 166/117.6 |
| 4,809,775 | 3/1989 | Fortin . | |
| 5,035,292 | 7/1991 | Bailey et al. . | |
| 5,109,924 | 5/1992 | Jurgens et al. . | |
| 5,193,620 | 3/1993 | Braddick | 175/81 X |

*Primary Examiner*—Ramon S. Britts
*Assistant Examiner*—Frank S. Tsay
*Attorney, Agent, or Firm*—Robert G. Upton

[57] ABSTRACT

A starter mill adapted for use with a whipstock to mill a window through the casing of a well for deviating the direction of drilling. The starter mill includes a bearing nose which is utilized to indicate completion of the milling process. As the mill nears completion of the milling process, the bearing nose will become wedged between the whipstock face and the casing preventing further downhole movement. The bearing nose will engage whipstock and casing, allowing the work string to continue to rotate although the decreased torque resulting from the absence of milling provides a clear signal that the milling operation is complete. The cutters of the mill are spaced a predetermined distance from the bearing nose to ensure completion of the casing window.

8 Claims, 6 Drawing Sheets

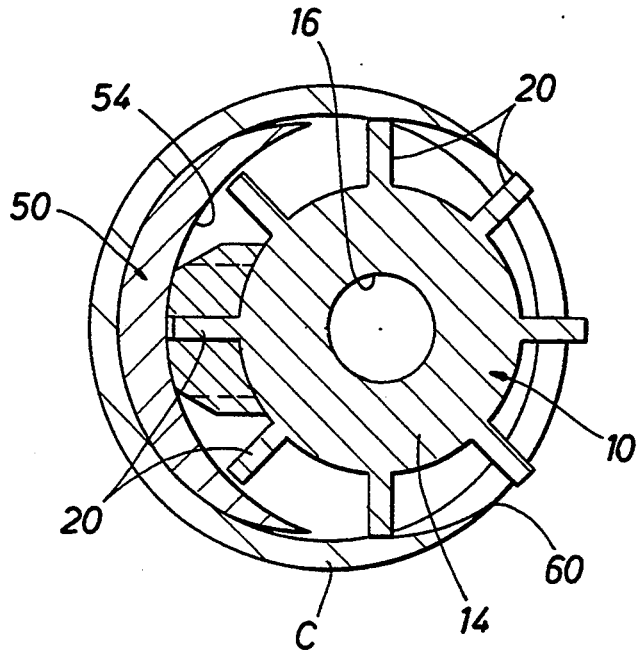
FIG. 6
FIG. 7
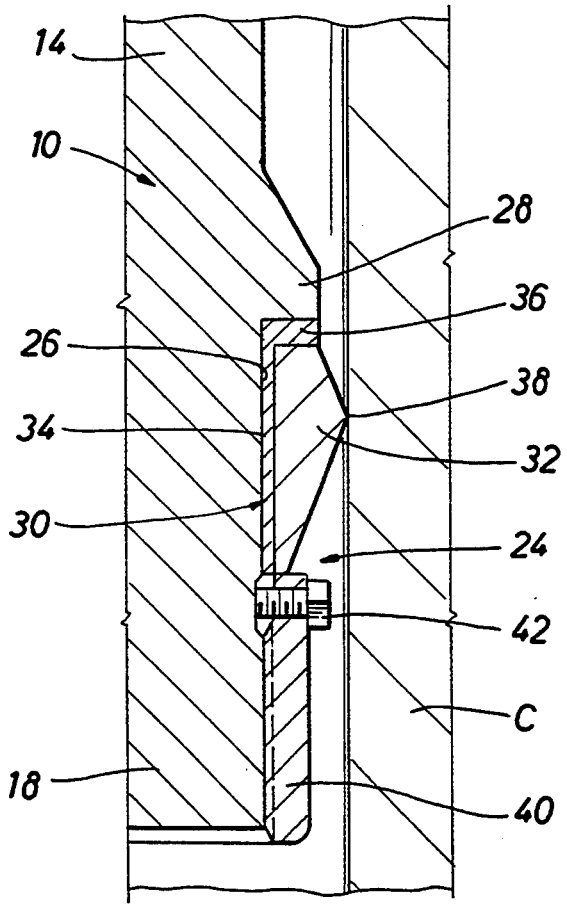

WHIPSTOCK STARTER MILL ASSEMBLY

BACKGROUND OF THE INVENTION

I. Field of tile Invention

This invention relates to a whipstock starter mill assembly for milling a window in a well casing and, in particular, to a starter mill incorporating a bearing nose to indicate completion of the milling process.

II. Description of the Prior Art

Modern drilling operations increasingly rely on deviated or horizontal wellbores to efficiently reach petroleum deposits from a main well. In many instances, the wellbore is drilled along a predetermined curvature in order to increase the reach of the well. Still in other cases, the deviated well is drilled from a main vertical well which, following well-known well completion methods, includes a casing liner to maintain well integrity. In order to form the deviated well, a window is formed in the casing using a milling tool and then continuing the drilling operation through the casing window.

Single trip whipstocks have become widely utilized to run and set the whipstock and thereafter mill the casing without tripping the drill string. The whipstock is run into the well on the milling tool and set in the wellbore by either mechanical or hydraulic means. The whipstock typically includes a packer or anchor with a whip having an angled whipface to direct the milling tool against the casing. Detachably connected to the whipstock is the milling tool which is connected to the drill string. Upon setting of the whipstock at the proper orientation within the casing, the milling tool is disconnected from the whip in order to initiate the milling process. Although the extent of milling can be predetermined many times, it remains a guessing game as to when the casing is sufficiently milled. If too little of the casing is milled away, too small a window is formed in the casing. Conversely, damage to the milling tool and/or the whipstock may occur if the milling tool is forced too far downhole. The milling tool may even become jammed in the wellbore. Thus, it becomes necessary to accurately determine the extent of milling of the casing.

The most widely used method of determining the extent of milling is to monitor the travel of the drill string during the milling operation, although this can prove to be inaccurate due to fluctuations in the drill string and deviations in the wellbore. Tattletales have also been developed which are sheared at a specified point signaling that the milling operation should be stopped. Such tattletales depend upon a variation in hydraulic pressure.

SUMMARY OF THE INVENTION

The present invention overcomes the disadvantages of the prior known starter mills by providing a means for preventing further milling while also providing a clear indication to the surface rig that milling should be stopped.

The starter mill assembly of the present invention is designed to be utilized with a whipstock having a whipface for directing the mill against the casing. The whipstock may be separately run into the well or run with the starter mill which is connected to a drill string. In either situation, the whipstock is set within the wellbore at the desired orientation to direct the mill and any subsequent drilling tools outwardly from the wellbore.

The starter mill is operatively connected to a drill string for rotation within the cased wellbore. The mill includes a plurality of milling blades circumferentially spaced on the outer surface of the mill body. The mill body tapers down to a mill nose in order to fit between the whip and the casing allowing complete milling of the casing. A bearing assembly is mounted to the mill nose comprising a rotatable bearing ring or the like. As the mill nose becomes wedged between the whipface and the casing near the end of the milling operation, the bearing ring will engage the casing and the whipface. Because of the enlarged circumference of the bearing ring, the mill nose will be free to rotate even as the bearing ring engages the casing and whipface. However, further downward travel of the mill will be prevented. With downhole movement prevented, no additional milling of the casing will occur, resulting in a significant decrease in torque in the drill string as the milling tool is free to rotate within the casing window. This freedom of rotation or decreased torque will be immediately recognized at the surface indicating an end to the milling operation. The milling tool can be tripped from the well and subsequent drilling operations conducted.

The above noted objects and advantages of the present invention will be more fully understood upon a study of the following description in conjunction with the detailed drawings.

BRIEF DESCRIPTION OF THE DRAWINGS

FIG. 6 is a lateral cross-section of the milling tool and whipstock within the casing taken along lines 4—4 of FIG. 3; and FIG. 7 is an enlarged partial cross-sectional view of the bearing nose.

DESCRIPTION OF THE PREFERRED EMBODIMENTS AND BEST MODE FOR CARRYING OUT THE INVENTION

Figure 1:
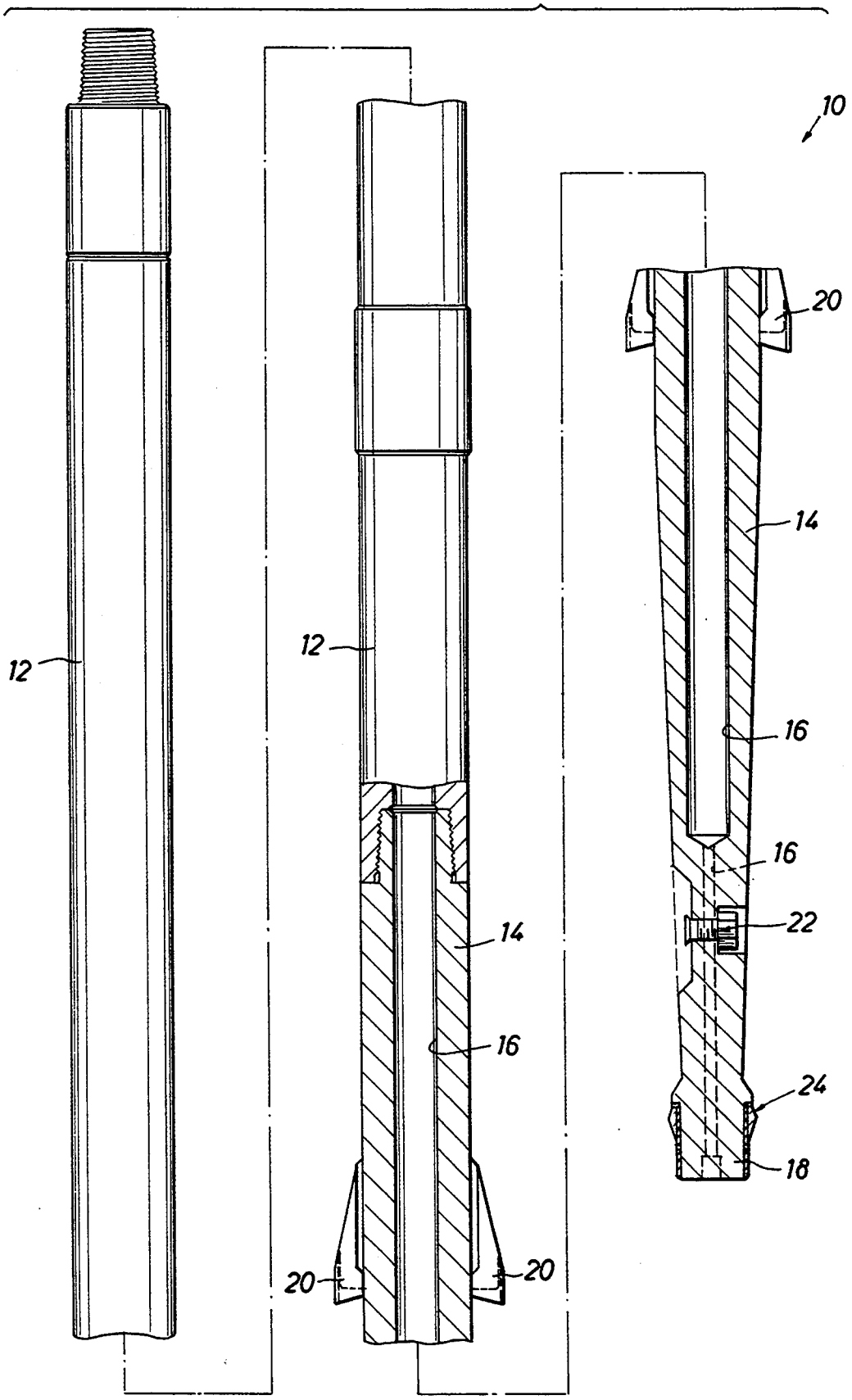
FIG. 1 is a partial cross-sectional view of a starter mill embodying the present invention.
Figure 2:
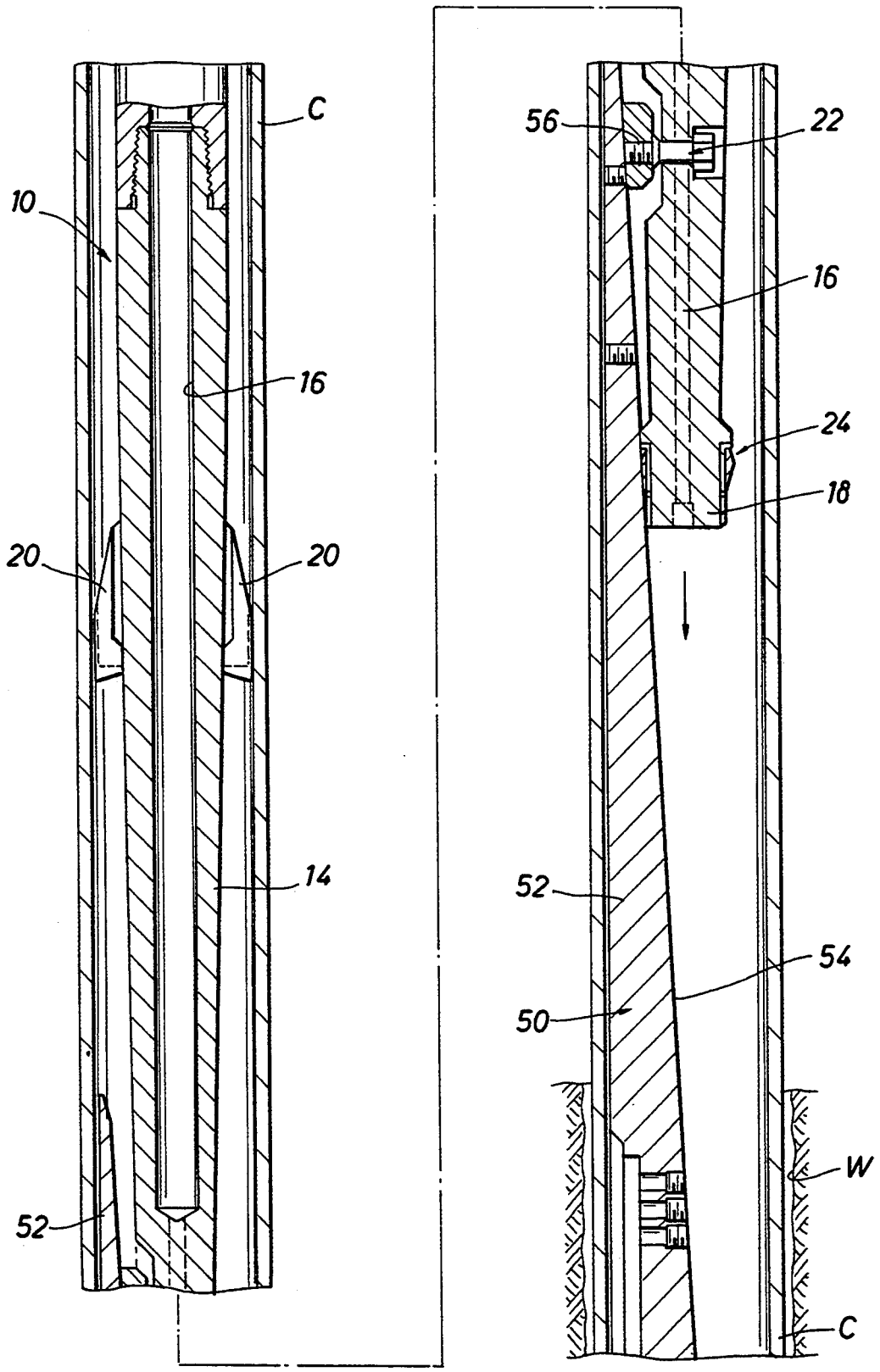
FIG. 2 is a cross-sectional view of a starter mill embodying the present invention.

Referring first to FIGS. 1 and 2, there is shown a starter mill 10 for milling a hole in a casing C of a wellbore W. In a preferred embodiment of the present invention, the starter mill 10 is run into the wellbore W in conjunction with a whipstock as will be subsequently described. The milling tool 10 may also be tripped into the wellbore W separately once the whipstock has been previously set in the wellbore. The starter mill 10 is designed to form a window in the casing C in order to facilitate deviated or horizontal drilling from the main wellbore W. The starter mill 10 of the present invention provides a clear indication to the surface rig of completion of the milling operation on the casing C so that the milling tool 10 may be tripped from the well W to run a subsequent drilling tool.

The milling tool 10 is run into the well W on a drill string 12 threadably connected thereto for rotatably operating the mill 10. The starter mill 10 includes an elongated body 14 with an axial fluid passageway 16. The body 14 has a tapered configuration narrowing to a reduced diameter nose 18 at the downhole end of the body 14. The fluid passageway 16 in the body 14 may be utilized to deliver hydraulic fluid to a hydraulically-set anchor-packer on the whipstock in a one-trip system as is well known. Alternatively, the fluid passageway 16 may be utilized to wash away debris accumulated in the wellbore W during the milling operation.

Attached to the outer periphery of the body 14 at a predetermined position along the body 14 are a plurality of circumferentially spaced cutting blades 20. These blades 20 are specially designed to mill away the casing C as the milling tool 10 is rotated within the wellbore W.

In a one-trip whipstock system, means may be provided for detachably connecting the mill 10 to a whipstock for setting the whipstock in the wellbore W. As a result, the mill 10 and the whipstock may be run into the wellbore W in a single trip of the drill string 12. In such a system, the starter mill 10 will include a fastener 22 for detachably connecting the mill 10 and whipstock.

in a preferred embodiment of the present invention, the nose 18 of the starter mill 10 includes a bearing assembly 24 which allows rotation of the milling tool 10 despite wedging engagement of the nose 18 with the casing C. As best shown in FIG. 7, the bearing assembly 24 is mounted within a circumferential shoulder 26 formed in the nose 18 of the body 14. Formation of the shoulder 26 creates a circumferential flange 28 in the body 14 to limit the upward travel of the bearing assembly 24. The bearing assembly 24 includes an inner bearing sleeve 30 coaxially mounted to the body 14 and a wear ring 32 coaxially mounted to the bearing sleeve 30. In a preferred embodiment, the bearing sleeve 30 comprises a sleeve portion 34 bearing against the shoulder 26 and a flange portion 36 bearing against the body flange 28. The wear ring 32, which seats within the bearing sleeve 30, has a substantially pyramidical cross sectional configuration with an outer circumferential point 38 adapted to engage the casing C. The bearing assembly 24 is maintained on the hose 18 by a retaining nut 40. The retaining nut 40 is preferably threadably mounted to the nose 18 to positionally capture the bearing assembly 24 between the flange 28 and the retaining nut 40. A set screw 42 is included on the retaining nut 40 to prevent inadvertent removal of the retaining nut 40.

Figure 3:
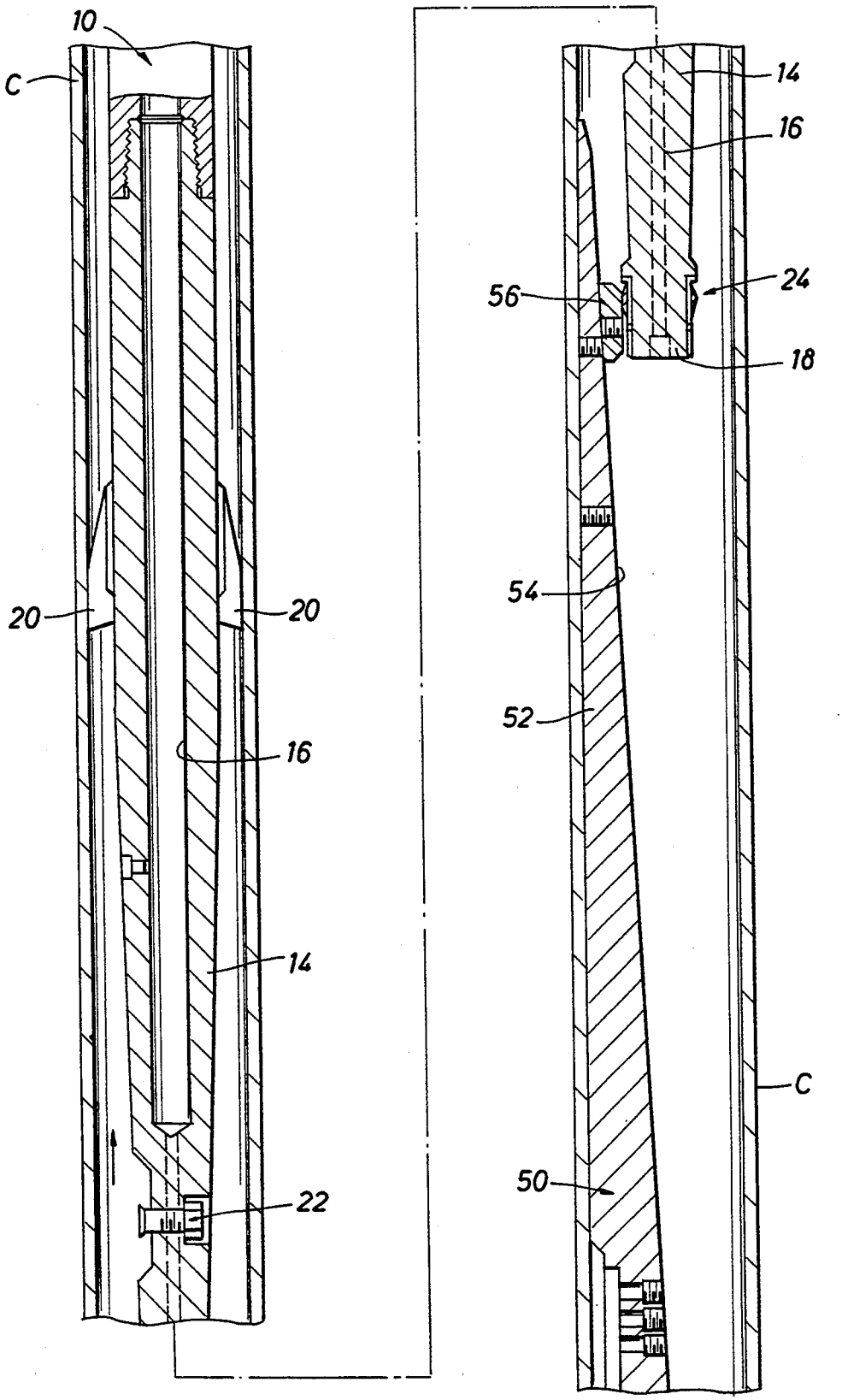
FIG. 3 is a cross-sectional view showing the starter mill being disconnected from the whipstock.
Figure 4:
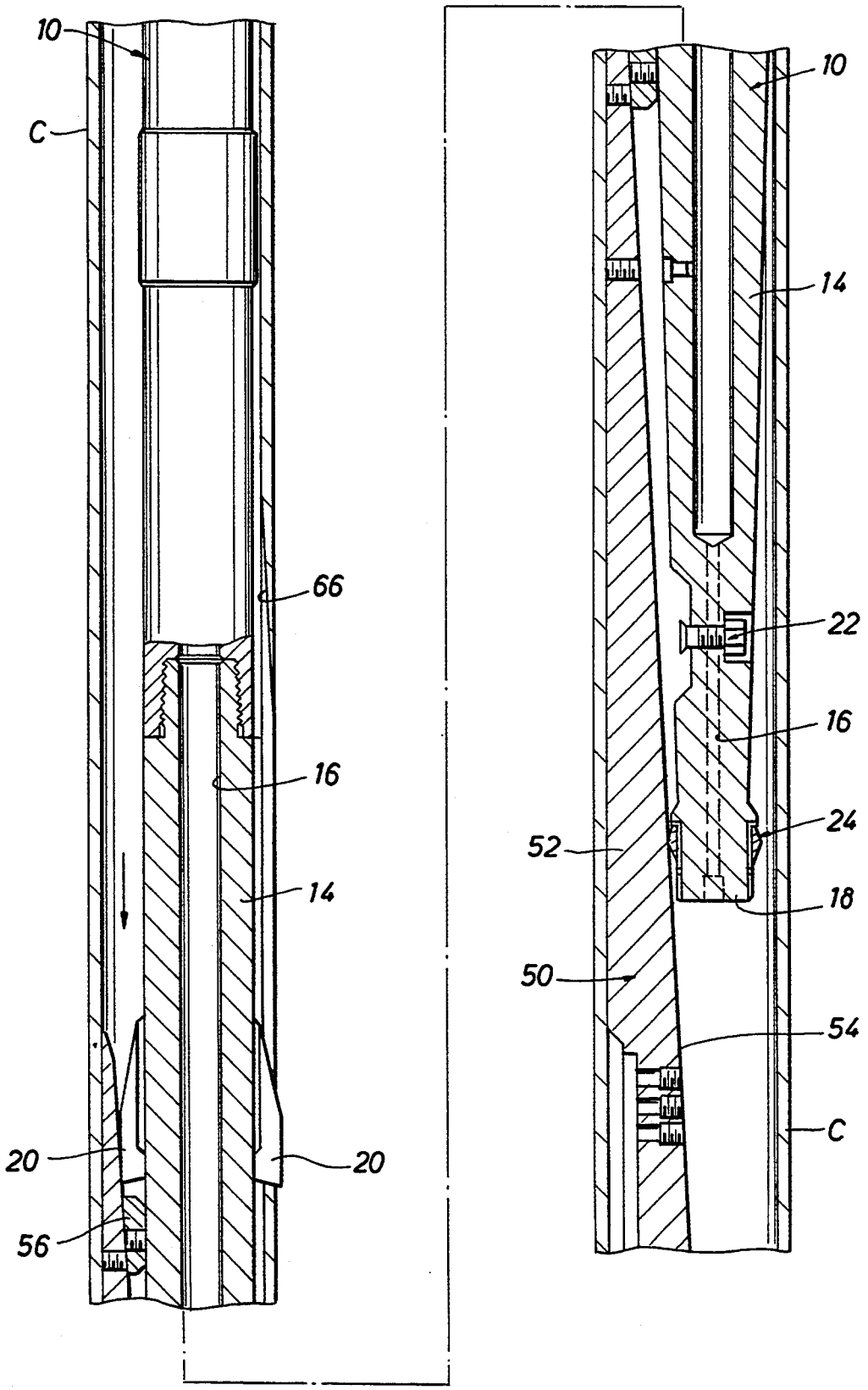
FIG. 4 is a cross-sectional view showing the starter mill disconnected from the whipstock and the milling operation initiated.
Figure 5:
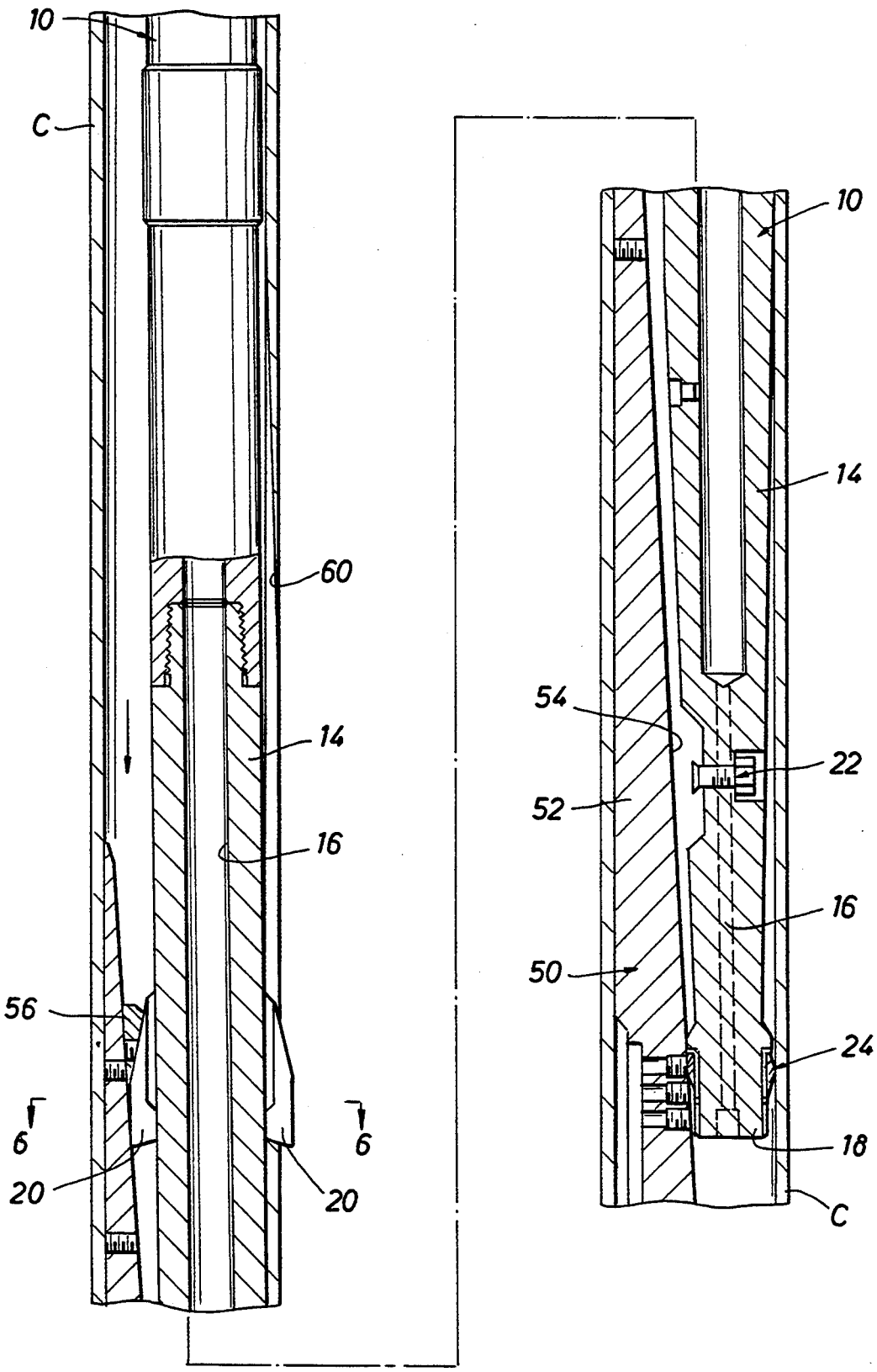
FIG. 5 is a cross-sectional view showing the milling operation completed and the bearing nose wedged between the whipface and the casing.

Referring now to FIGS. 2 through 6, the starter mill 10 of the present invention is shown in conjunction with a whipstock 50 for diverting the direction of drilling from the main wellbore W. The present invention will be described in conjunction with a one-trip whipstock system although it is to be understood that the starter mill 10 may be run separately from the whipstock 50. The whipstock 50 typically includes means for setting the whipstock 50 such as an anchor or packer (not shown) and a whip 52 with a slanted whipface 54 to divert any drilling tools. As shown in FIG. 2, the entire assembly is run into the wellbore W. The milling tool 10 is detachably connected to the whipstock 50 through the fastener 22 which is connected to a shear bolt block 56. Once positioned at the desired location along the casing C, the whipstock 50 is set within the casing C through hydraulic or mechanical means. With the whipstock 50 set, tension or compression is applied to the drill string 12 shearing the bolt 22 from the block 56 disconnecting the starter mill from the whipstock 50 as shown in FIG. 3. As the starter mill is once again moved downhole, the drill string 12 and the mill 10 are rotated to rotate the milling blades 20 allowing the blades 20 to mill a window 60 in the casing C (FIG. 4). Milling continues as the starter mill 10 travels downhole until the desired window 60 is formed in the casing C (FIG. 5).

Unlike prior known milling systems which depended upon calculation of the travel distance of the starter mill 10 during the milling operation, the bearing nose 24 of the present invention provides a clear indication that milling is completed. With the distance between the milling blades 20 and the bearing nose 24 known, once the bearing nose 24 is prevented from further travel downhole, the extent of milling is known. As shown in FIG. 5, at a predetermined point the bearing nose 24 becomes wedged between the whipface 54 and the casing C. Although further downhole travel is prevented, the bearing assembly 24 allows the body 14 to continue rotating even as the wear ring 32 engages the casing C and whipface 54. However, since no further downhole travel is permitted, milling of the casing C will end, causing the milling blades 20 to spin freely, substantially decreasing the torque applied through the drill string 12. This can be instantly recognized at the surface providing a clear indication that milling should be ceased. At this point, the starter mill 10 may be tripped from the wellbore W. Subsequent drilling operations may then be conducted.

It will of course be realized that various modifications can be made in the design and operation of the present invention without departing from the spirit thereof. Thus while the principal preferred construction and mode of operation of the invention have been explained in what is now considered to represent its best embodiments, which have been illustrated and described, it should be understood that within the scope of the appended claims the invention may be practiced otherwise than as specifically illustrated and described.

What is claimed is:

1. A starter mill for milling a window in a wellbore casing, said starter mill diverted against the casing by a whipstock having a whipface, the whipstock set in the wellbore casing at a predetermined position, said starter mill comprising:

an elongated body with at least one milling blade mounted thereto, said at least one milling blade milling the casing upon rotation of said body within the wellbore; and a bearing assembly mounted to said body, said bearing assembly including means selectively engaging the casing and whipface simultaneously upon completion of milling, said bearing assembly includes a bearing sleeve mounted to a downhole end of said body and a wear ring forming said engagement means coaxially mounted to said bearing sleeve, said wear ring has a substantially triangular cross-sectional configuration forming a circumferential edge selectively engageable with the casing and whipface, said downhole end of said body includes a reduced diameter portion forming a radial flange, said .flange preventing upward movement of said bearing assembly coaxially mounted to said reduced diameter portion of said body, whereby said body may be rotated independently of said engagement means indicating completion of milling of the casing.

2. The starter mill as defined in claim 1 and further comprising a retaining nut threadably mounted to said reduced diameter portion of said body to positionally capture said bearing assembly between said retaining nut and said radial flange.

3. A starter mill for milling a window in a wellbore casing, said starter mill diverted against the casing by a whipstock having a whipface, the whipstock set in the wellbore casing at a predetermined position, said starter mill comprising:

an elongated body with milling means mounted thereto, said milling means milling the casing window upon rotation of said body within the wellbore, said milling means being urged against the casing by the whipface; and a bearing assembly mounted to a downhole end of said body and selectively engageable with the casing and whipface simultaneously upon completion of the milling operation, said bearing assembly including a bearing sleeve mounted to said downhole end of said body and a wear ring coaxially mounted to said bearing sleeve, said body includes a radial flange proximate said bearing assembly to prevent uphole movement of said bearing assembly, said wear ring engaging the casing and whipface upon completion of milling allowing rotation of said body independently of said wear ring providing an indication to the surface that milling of the casing window is complete.

4. The starter mill as defined in claim 3 and further comprising a retaining nut threadably mounted to said downhole end of said body, said retaining nut positionally capturing said bearing assembly on said body between said radial flange and said retaining nut.

5. The starter mill as defined in claim 3 wherein said bearing sleeve includes a sleeve portion coaxial with said body and a flange portion perpendicular to said sleeve portion, said flange portion bearing against said radial flange of said body.

6. The starter mill as defined in claim 4 wherein said downhole end of said body includes a reduced diameter portion forming said radial flange, said bearing assembly and retaining nut mounted to said reduced diameter portion.

7. The starter mill as defined in claim 6 wherein said wear ring has a substantially triangular cross-sectional configuration forming a circumferential edge selectively engageable with the casing and whipface.

8. A one-trip whipstock assembly for diverting the direction of drilling in a primary wellbore, said whipstock assembly run into the wellbore on a drill string, said assembly comprising:

a whipstock having a whipface and means for setting said whipstock at a predetermined position with the wellbore; and a milling tool detachably connected to said whipstock for selectively forming a secondary wellbore, said milling tool including:

an elongated body with milling means mounted thereto; and a bearing assembly mounted to a downhole end of said body, said bearing assembly including means selectively engageable with the wellbore wall and whipface simultaneously whereby said body may be rotated independently of said engagement means providing an indication to the surface that milling of the secondary wellbore is complete said body further including a radial flange proximate said bearing assembly to prevent uphole movement of said bearing assembly.

* * * * *